US006584794B2

(12) United States Patent
Takeuchi et al.

(10) Patent No.: US 6,584,794 B2
(45) Date of Patent: Jul. 1, 2003

(54) EJECTOR CYCLE SYSTEM

(75) Inventors: Hirotsugu Takeuchi, Nagoya (JP); Makoto Ikegami, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/188,006

(22) Filed: Jul. 1, 2002

(65) Prior Publication Data

US 2003/0005717 A1 Jan. 9, 2003

(30) Foreign Application Priority Data

Jul. 6, 2001 (JP) ..... 2001-206683
May 24, 2002 (JP) ..... 2000-150786

(51) Int. Cl.[7] ..... F25B 1/06; F25B 47/00
(52) U.S. Cl. ..... 62/278; 62/500
(58) Field of Search ..... 62/278, 500, 116, 62/81, 160, 151, 512

(56) References Cited

U.S. PATENT DOCUMENTS 3,670,519 A * 6/1972 Newton ..... 62/116
4,342,200 A * 8/1982 Lowi, Jr. ..... 62/191
4,343,157 A 8/1982 Hattori
4,523,437 A * 6/1985 Briley ..... 62/238.4
4,840,042 A * 6/1989 Ikoma et al. ..... 62/324.1
2002/0134103 A1 * 9/2002 Nishii ..... 62/500

FOREIGN PATENT DOCUMENTS

JP 52-156450 12/1977
JP 54-131156 10/1979
JP 6-11197 1/1994

* cited by examiner

*Primary Examiner*—Melvin Jones
(74) *Attorney, Agent, or Firm*—Harness, Dickey & Pierce, PLC

(57) ABSTRACT

In an ejector cycle system, hot gas refrigerant discharged from a compressor is introduced into an evaporator through a bypass passage while bypassing an ejector and a gas-liquid separator in a defrosting operation for defrosting frost generated on the evaporator. In addition, a throttle or a check valve is provided in a refrigerant passage from the gas-liquid separator to a refrigerant inlet side of the evaporator. Accordingly, in the defrosting operation, the hot gas refrigerant from the compressor can be accurately introduced into the evaporator through the bypass passage without flowing toward the gas-liquid separator.

17 Claims, 8 Drawing Sheets

EJECTOR CYCLE SYSTEM

CROSS-REFERENCE TO RELATED APPLICATION

This application is related to Japanese Patent Applications No. 2001-206683 filed on Jul. 6, 2001, and No. 2002-150786 filed on May 24, 2002, the contents of which are hereby incorporated by reference.

BACKGROUND OF THE INVENTION

1. Field of the Invention

The present invention relates to an ejector cycle system having an improved refrigerant passage structure.

2. Description of Related Art

In an ejector cycle System described in JP-A-6-11197, an ejector sucks gas refrigerant evaporated in an evaporator at a low pressure side, and increases a pressure of refrigerant to be sucked into a compressor by converting an expansion energy to a pressure energy. In the ejector cycle system, refrigerant discharged from the ejector flows into a gas-liquid separator, so that liquid refrigerant separated in the gas-liquid is supplied to the evaporator, and gas refrigerant separated in the gas-liquid separator is sucked into the compressor. Accordingly, the refrigerant cycle system has a refrigerant flow circulating through the compressor, a radiator, the ejector, the gas-liquid separator and the compressor in this order, and a refrigerant flow circulating through the gas-liquid separator, the evaporator, the ejector and the gas-liquid separator in this order. In the ejector cycle system, the evaporator may be frosted sometimes, and it is necessary to defrost the evaporator. However, in the ejector cycle system, it is impossible to perform defrosting operation of the evaporator.

SUMMARY OF THE INVENTION

In view of the foregoing problems, it is an object of the present invention to provide an ejector cycle system having an improved refrigerant passage structure.

It is an another object of the present invention to provide an ejector cycle system which can substantially perform a defrosting operation of an evaporator.

It is a further another object of the present invention to provide an ejector cycle system which can shorten a defrosting time period.

According to the present invention, an ejector cycle system includes a compressor for sucking and compressing refrigerant, a radiator which cools refrigerant discharged from the compressor, an evaporator for evaporating the refrigerant to obtain cooling capacity, a gas-liquid separator having a gas refrigerant outlet coupled to a refrigerant suction side of the compressor and a liquid refrigerant outlet coupled to a side of the evaporator, and an ejector. The ejector includes a nozzle for converting a pressure energy of high-pressure refrigerant from the radiator to a speed energy so that the high-pressure refrigerant is decompressed and expanded, and a pressure-increasing portion in which the speed energy is converted to the pressure energy so that the pressure of refrigerant is increased while refrigerant discharged from the nozzle and gas refrigerant from the evaporator are mixed. In the ejector cycle system, refrigerant discharged from the compressor is introduced into the evaporator while bypassing the ejector and the gas-liquid separator, in a defrosting operation for defrosting frost generated on the evaporator. Accordingly, it can prevent liquid refrigerant in the gas-liquid separator from flowing into the evaporator in the defrosting operation. Therefore, the defrosting operation can be effectively performed, and a defrosting time period for which the defrosting operation is performed can be made shorter. That is, the ejector cycle system has an improved refrigerant passage structure for performing the defrosting operation of the evaporator.

Preferably, a pressure-loss generating unit for generating a predetermined pressure loss is disposed in a refrigerant passage through which the liquid refrigerant outlet of the gas-liquid separator communicates with the evaporator. For example, the pressure-loss generating unit is a throttle member, or a valve which adjusts an opening degree of the refrigerant passage to generate a predetermined pressure loss in the refrigerant passage. Therefore, hot gas refrigerant discharged from the compressor can be accurately flows into the evaporator through a bypass passage without flowing toward the gas-liquid separator.

Preferably, a check valve is disposed in the refrigerant passage through which the liquid refrigerant outlet of the gas-liquid separator communicates with the evaporator, to prohibit a refrigerant flow from the evaporator toward the gas-liquid separator through the refrigerant passage. Therefore, the defrosting operation of the evaporator can be accurately performed using hot gas refrigerant introduced into the evaporator through the bypass passage.

Further, an another gas-liquid separator is disposed in a refrigerant passage connecting the evaporator and the ejector, and has a refrigerant outlet from which the gas refrigerant separated in the another gas-liquid separator is sucked into the ejector. Therefore, hot gas refrigerant from the compressor is introduced into the evaporator through the bypass passage in the defrosting operation to heat the evaporator so that refrigerant (liquid refrigerant) staying in the evaporator is discharged outside the evaporator. In this case, liquid refrigerant among the refrigerant flowing from the evaporator stays in the another gas-liquid separator, and gas refrigerant separated in the another gas-liquid separator is sucked into the ejector. Thus, operation of the ejector cycle system with the ejector can be effectively performed.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

A first preferred embodiment of the present invention will be now described with reference to FIGS. 1–3. In the first embodiment, an ejector cycle system of the present invention is typically used for a vehicle air conditioner.

In the first embodiment, a compressor 100 is driven by a driving source such as a vehicle engine (not shown) to suck and compress refrigerant (e.g., carbon dioxide in the first embodiment). In a radiator 200 (i.e., high-pressure side heat exchanger), refrigerant discharged from the compressor 100 is heat-exchanged with air (outside air) outside a passenger compartment. In an evaporator 300 (i.e., low-pressure side heat exchanger), liquid refrigerant in the ejector cycle system is heat-exchanged with air to be blown into a passenger compartment to cool air. An ejector 400 decompresses and expands high-pressure refrigerant flowing from the radiator 200 to suck therein gas refrigerant evaporated in the evaporator 300, and converts an expansion energy to a pressure energy to increase a pressure of refrigerant to be sucked into the compressor 100.

Figure 2:
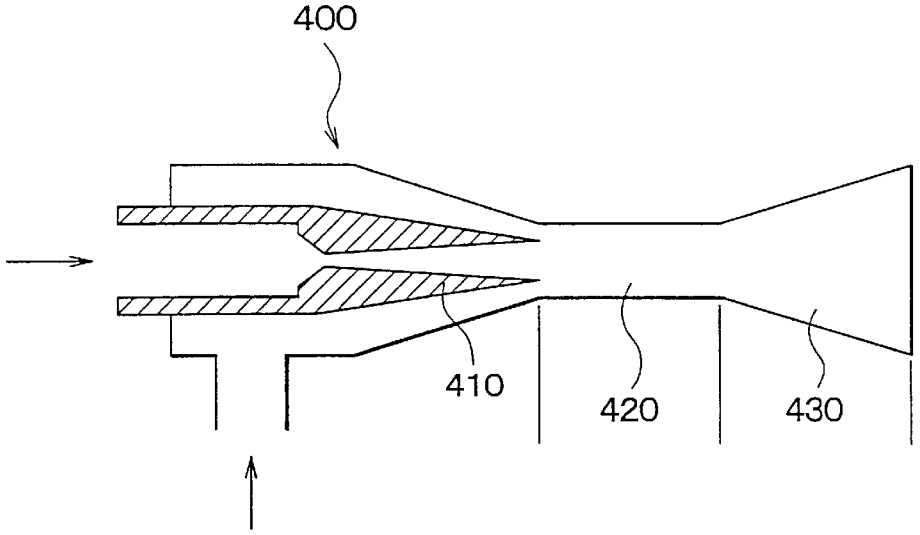
FIG. 2 is an enlarged schematic diagram showing an ejector used in the ejector cycle system according to the first embodiment.

As shown in FIG. 2, the ejector 400 includes a nozzle 410, a mixing portion 420 and a diffuser 430. The nozzle 410 decompresses and expands the high-pressure refrigerant flowing from the radiator 200 by converting a pressure energy (pressure head) of the refrigerant to a speed energy (speed head) thereof. In the mixing portion 420, the refrigerant evaporated in the evaporator 300 is sucked by high-speed refrigerant jetted from the nozzle 410. Further, in the diffuser 430, the speed energy of refrigerant is converted to the pressure energy so that the pressure of refrigerant to be sucked into the compressor 100 is increased, while the refrigerant jetted from the nozzle 410 and the refrigerant sucked from the evaporator 300 are mixed.

Here, the refrigerant pressure in the ejector 400 is increased not only in the diffuser 430, but also in the mixing portion 420. Therefore, in the ejector 400, a pressure-increasing portion is constructed by the mixing portion 420 and the diffuser 430. In the first embodiment, a cross-sectional area of the mixing portion 420 is made constant until the diffuser 430. However, the mixing portion 420 may be tapered so that the cross-sectional area becomes larger toward the diffuser 430.

Figure 1:
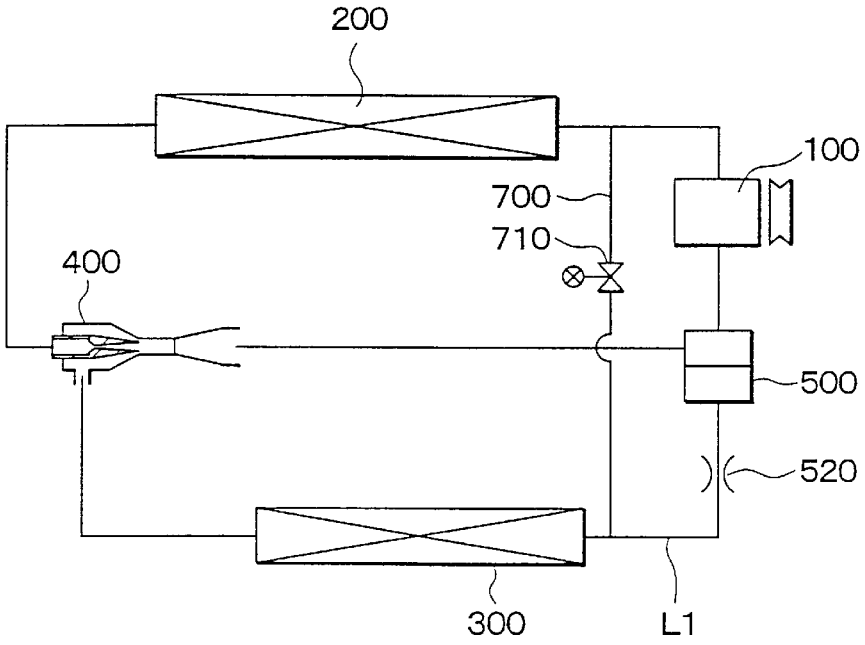
FIG. 1 is a schematic diagram showing an ejector cycle system according to a first preferred embodiment of the present invention.

As shown in FIG. 1, refrigerant from the ejector 400 flows into a gas-liquid separator 500, to be separated into gas refrigerant and liquid refrigerant in the gas-liquid separator 500. The gas refrigerant separated in the gas-liquid separator 500 is sucked into the compressor 100, and the separated liquid refrigerant is sucked toward the evaporator 300.

The gas-liquid separator 500 is connected to the evaporator 300 through a refrigerant passage L1. In the refrigerant passage L1, a throttle 520 (i.e., pressure-loss generating unit) such as a capillary tube and a fixed throttle is provided. When refrigerant flows through the throttle 510, a predetermined pressure loss generates, and the refrigerant to be sucked into the evaporator 300 is sufficiently decompressed. Therefore, a pressure loss more than a pressure loss caused in the evaporator 300 and the pressure-increasing portion of the ejector 400 is generated by the throttle 520 in the refrigerant passage L1.

Further, a hot gas passage 700 (bypass passage) is provided so that high-temperature high-pressure refrigerant discharged from the compressor 100 is introduced into the refrigerant passage L1 while bypassing the radiator 200, the ejector 400 and the gas-liquid separator 500. That is, through the hot gas passage 700, a refrigerant inlet side of the radiator 200 communicates with the refrigerant passage L1. A valve 710 is disposed in the hot gas passage 700 to open and close the hot gas passage 700 and to decompress the refrigerant flowing through the hot gas passage 700 to a predetermined pressure lower than a resisting pressure of the evaporator 300.

Next, operation of the ejector cycle system will be now described. When the compressor 100 starts operation, the gas refrigerant from the gas-liquid separator 500 is sucked into the compressor 100, and the compressed refrigerant is discharged from the compressor 100 into the radiator 200. Refrigerant is cooled in the radiator 200, and is decompressed in the nozzle 410 of the ejector 400 so that gas refrigerant in the evaporator 300 is sucked. The refrigerant sucked from the evaporator 300 and the refrigerant jetted from the nozzle 410 are mixed in the mixing portion 420, and the dynamic pressure of refrigerant is converted to the hydrostatic pressure thereof. Thereafter, the refrigerant from the ejector 400 flows into the gas-liquid separator 500.

On the other hand, because gas refrigerant is sucked from the evaporator 300 into the ejector 400, liquid refrigerant from the gas-liquid separator 500 flows into the evaporator 300 to be evaporated by absorbing heat from air blown into the passenger compartment.

Figure 3:
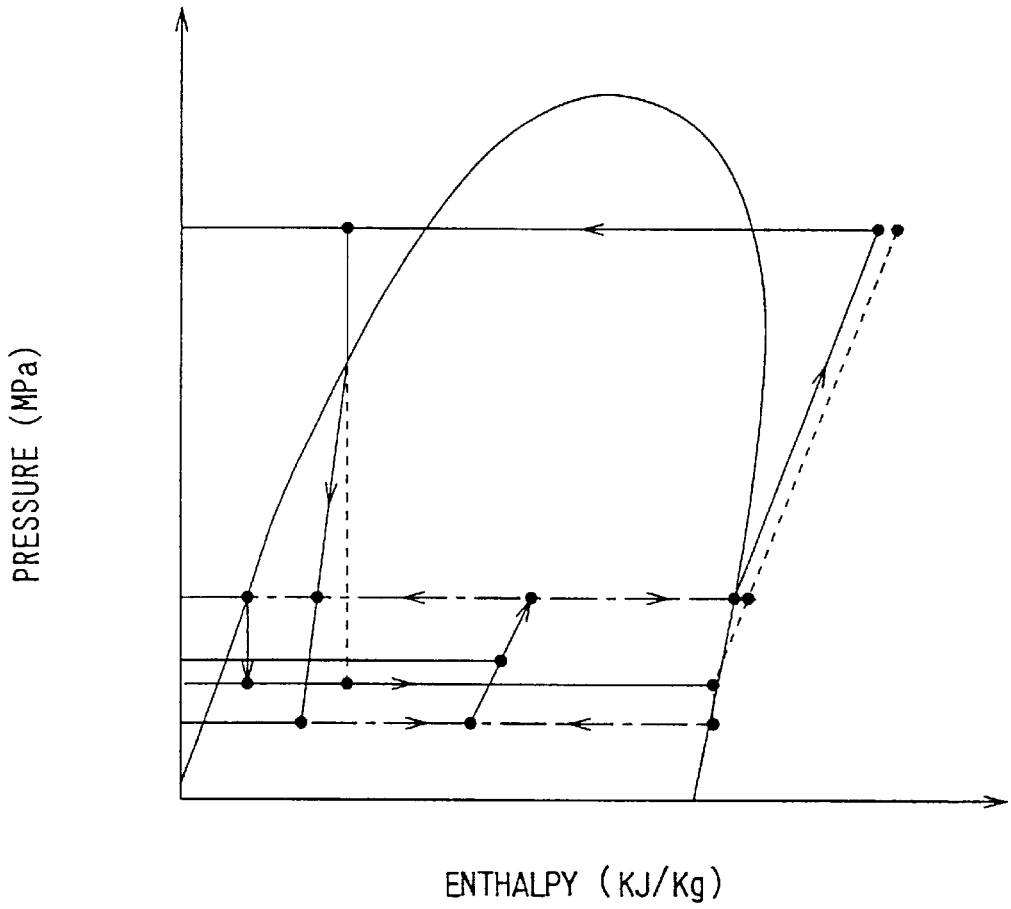
FIG. 3 is a Mollier diagram (p-h diagram) showing an operation of the ejector cycle system according to the first embodiment.

FIG. 3 shows a Mollier diagram showing the ejector cycle system of the first embodiment. As shown in FIG. 3, the cooling performance in the ejector cycle system can be improved.

When defrosting operation for removing frost generated on the evaporator 300 is performed, the valve 710 is opened so that refrigerant discharged from the compressor 100 is introduced into the evaporator 300 through the hot gas passage 700 while bypassing the ejector 400 and the gas-liquid separator 500. Therefore, the evaporator 300 is heated and defrosted by high-temperature refrigerant (hot-gas refrigerant). Thus, in the defrosting operation of the evaporator 300, refrigerant discharged from the compressor 100 flows through the evaporator 300, the ejector 400, the gas-liquid separator 500 in this order, and returns to the compressor 100.

According to the first embodiment of the present invention, because the throttle 520 is disposed in the refrigerant passage L1 from the gas-liquid separator 500 to a refrigerant inlet side of the evaporator 300, refrigerant introduced from the hot gas passage 700 toward the evaporator 300 accurately flows into the evaporator 300 without flowing toward the gas-liquid separator 500. Accordingly, the defrosting operation of the evaporator 300 can be accurately performed.

Figure 14:
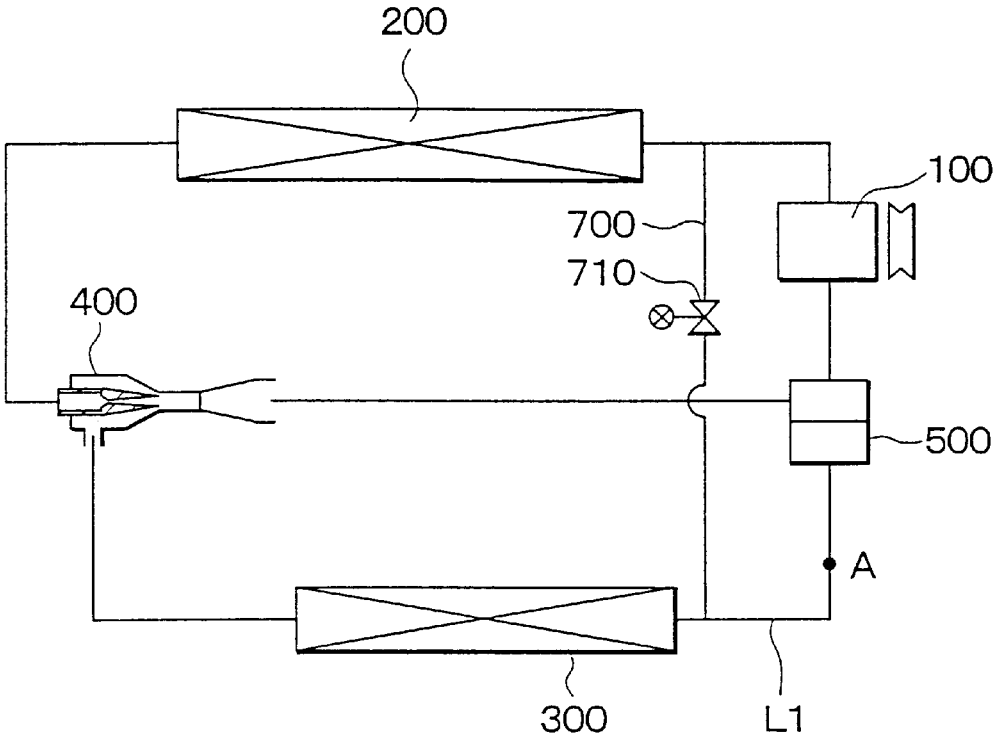
FIG. 14 is a schematic diagram showing an ejector cycle system of a comparison example.

When the throttle 520 is not provided in the refrigerant passage L1 as shown in a comparison example shown in FIG. 14, a pressure loss of a refrigerant passage from the bypass passage 700 to the gas-liquid separator 500 through a point A may be smaller than a pressure loss in a refrigerant passage from the bypass passage 700 to the gas-liquid separator 500 through the evaporator 300 and the ejector 400. In this case, refrigerant introduced from the bypass passage 700 hardly flows into the evaporator 300, but readily flows directly into the gas-liquid separator 500 through the refrigerant passage L1. In this case, it is difficult to perform the defrosting operation of the evaporator 300.

According to the first embodiment of the present invention, because the throttle 520 is provided in the refrigerant passage L1, the pressure loss of the refrigerant passage from the bypass passage 700 to the gas-liquid separator 500 through the throttle 520 can be made larger than the pressure loss in the refrigerant passage from the bypass passage 700 to the gas-liquid separator 500 through the evaporator 300 and the ejector 400. Accordingly, in the first embodiment, the defrosting operation of the evaporator 300 can be accurately performed. In addition, in the first embodiment of the present invention, refrigerant discharged from the compressor 100 is introduced into the evaporator 300 through the hot gas passage 700 while bypassing the ejector 400 and the gas-liquid separator 500 in the defrosting operation. Accordingly, it can prevent liquid refrigerant in the gas-liquid separator 500 from flowing into the evaporator 300 in the defrosting operation, and the defrosting time period for which the defrosting operation is performed can be shortened.

Figure 4:
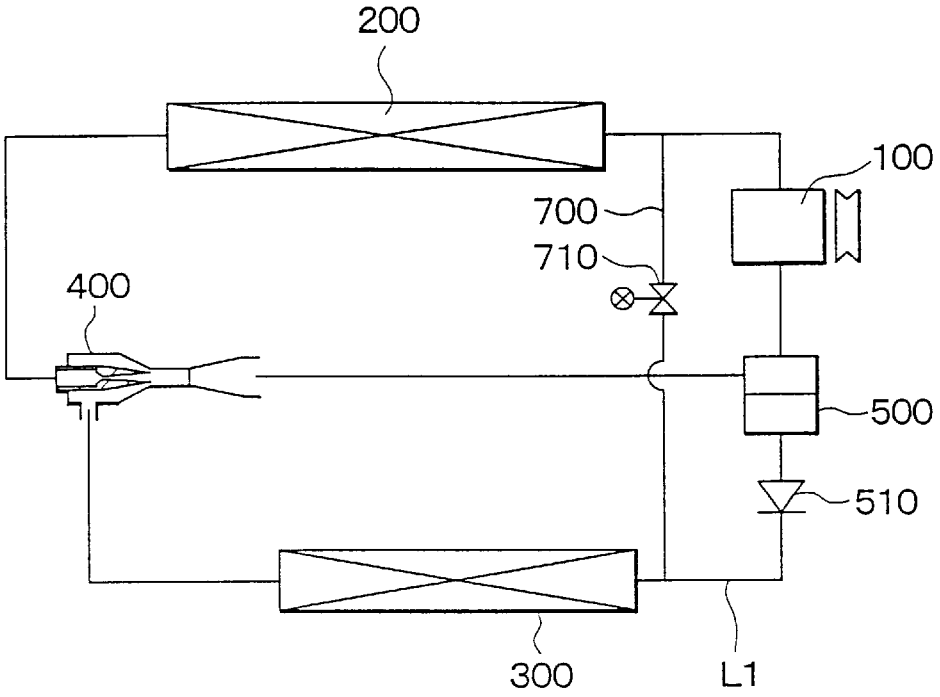
FIG. 4 is a schematic diagram showing an ejector cycle system according to a second preferred embodiment of the present invention.
Figure 5:
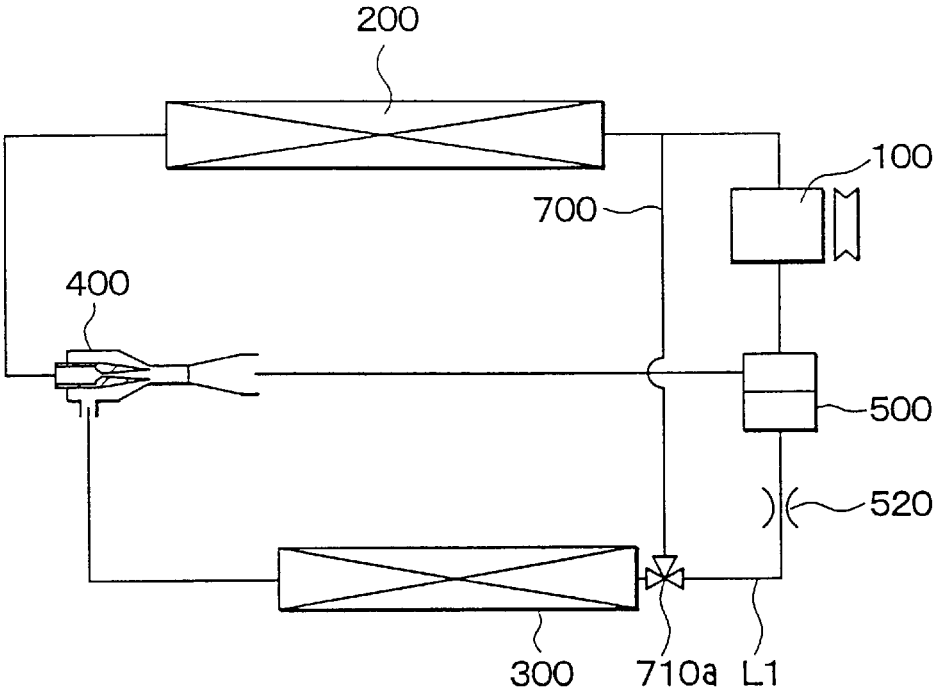
FIG. 5 is a schematic diagram showing an ejector cycle system according to a third preferred embodiment of the present invention.

A second embodiment of the present invention will be now described with reference to FIG. 4. In the second embodiment, instead of the fixed throttle 520, a check valve 510 is provided in the refrigerant passage L1. The check valve 510 is disposed to allow a direct refrigerant flow from the gas-liquid separator 500 to the evaporator 300, and to prohibit a direct refrigerant flow from the evaporator 300 to the gas-liquid separator 500. Accordingly, in the defrosting operation of the evaporator 300, hot gas refrigerant discharged from the compressor 100 can be accurately introduced into the evaporator 300.

Further, in the second embodiment, the refrigerant passage L1 is set to generate a predetermined pressure loss while refrigerant flow, in order to reduce the pressure of refrigerant sucked into the evaporator 300 and to accurately reduce the pressure (evaporation pressure) in the evaporator 300. For example, the refrigerant passage L1 can formed by a capillary tube or can be provided with a fixed throttle. Accordingly, in the second embodiment, the advantage similar to the above-described first embodiment can be obtained. Accordingly, in the defrosting operation of the evaporator 300, hot gas refrigerant discharged from the compressor 100 can be accurately introduced into the evaporator 300.

A third embodiment of the present invention will be now described. In the third embodiment, a three-way valve 710*a* is further provided in a joint portion where the hot gas passage 700 and the refrigerant passage L1 are joined. Accordingly, in the defrosting operation of the evaporator 300, high-temperature refrigerant discharged from the compressor 100 can be accurately introduced into the evaporator 300 through the three-way valve 710*a*. In the third embodiment, a decompression unit for decompressing refrigerant can be provided in the three-way valve 710*a*.

Figure 6:
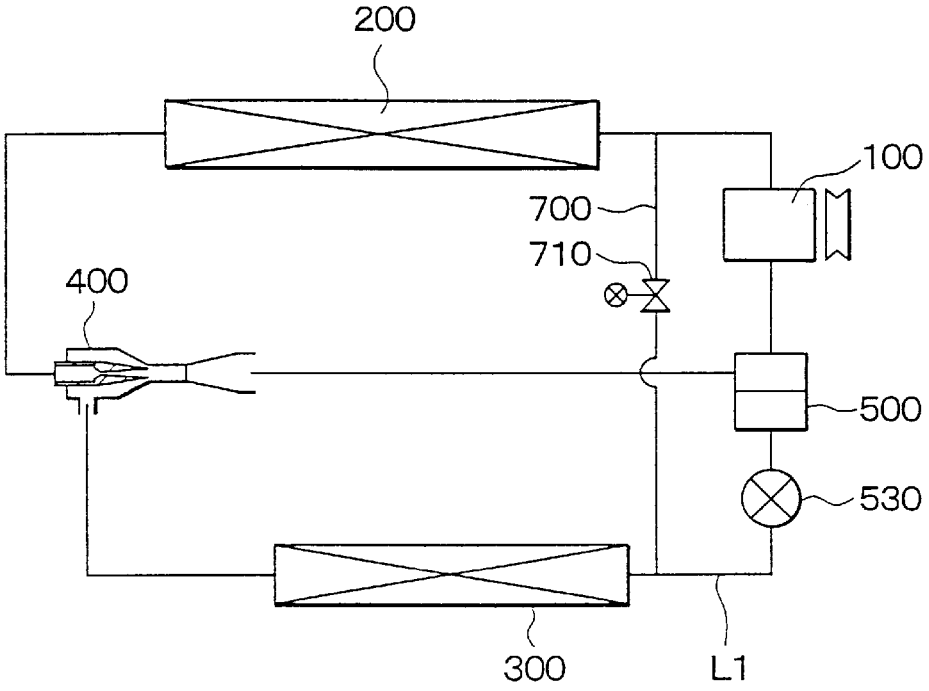
FIG. 6 is a schematic diagram showing an ejector cycle system according to a fourth preferred embodiment of the present invention.

A fourth preferred embodiment of the present invention will be now described with reference to FIG. 6. In the fourth embodiment, instead of the fixed throttle 520 described in the first embodiment, a valve 530 that is controlled to change its opening degree is provided in the refrigerant passage L1. Specifically, the opening degree of the valve 530 can be controlled from zero to a predetermined opening degree by which a predetermined pressure loss is generated in the refrigerant passage L1. When the opening degree of the valve 530 is controlled to zero, the refrigerant passage L1 is closed. Accordingly, in the defrosting operation, the valve 710 is opened and the valve 530 is closed.

Figure 7:
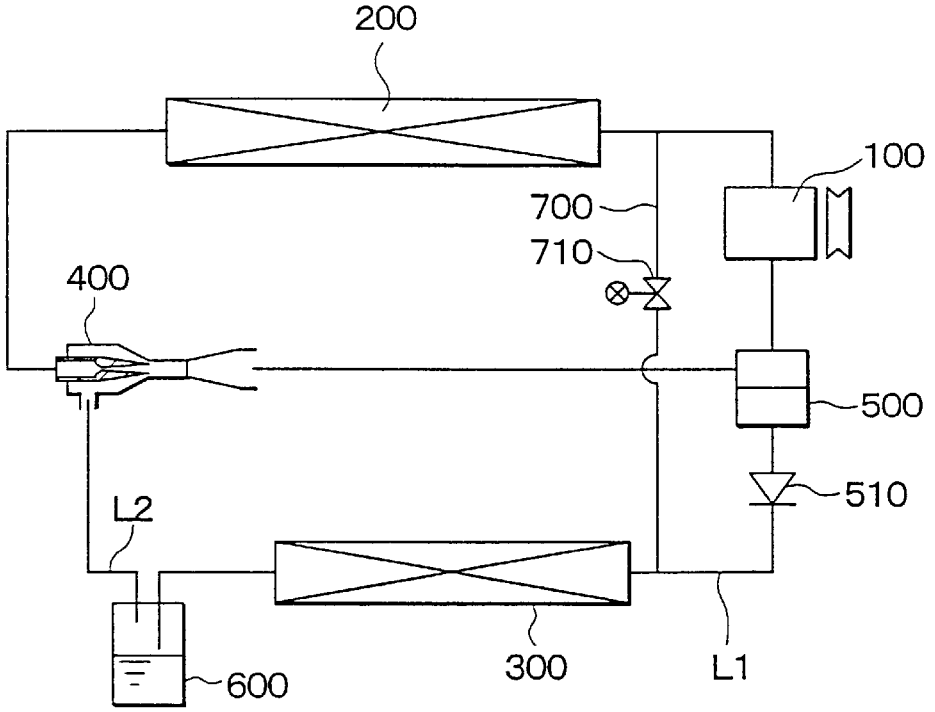
FIG. 7 is a schematic diagrams showing an ejector cycle system according to a fifth preferred embodiment of the present invention.

A fifth embodiment of the present invention will be now described with reference to FIG. 7. In the fifth embodiment, the gas-liquid separator 500 (referred to "first gas-liquid separator" in the fifth embodiment) is disposed in the refrigerant passage L1, and a second gas-liquid separator 600 is disposed in a refrigerant passage L2 connecting the evaporator 300 and the ejector 400. The second gas-liquid separator 600 is disposed to separate refrigerant flowing from the evaporator 300 into liquid refrigerant and gas refrigerant, and a gas-refrigerant outlet side of the second gas-liquid separator 600 is coupled to the mixing portion 420 of the ejector 400. In addition, the check valve 510 described in the second embodiment is disposed in the refrigerant passage L1.

When the frost generated on the evaporator 300 is defrosted in the defrosting operation, the valve 710 is opened so that high-temperature refrigerant (hot-gas refrigerant) discharged from the compressor 100 is introduced into the evaporator 300 while bypassing the ejector 400 and the first gas-liquid separator 500 to defrost the evaporator 300.

Because a relative-high pressure of refrigerant flowing out from the hot gas passage 700 is applied to a liquid-refrigerant outlet side of the first gas-liquid separator 500, refrigerant flowing into the first gas-liquid separator 500 from the ejector 400 does not flows toward the evaporator.

According to the fifth embodiment, because the second gas-liquid separator 600 is disposed in the refrigerant passage L2 connecting the evaporator 300 and the ejector 400, hot-gas refrigerant introduced into the evaporator 300 heats the evaporator 300 so that liquid refrigerant staying in the evaporator 300 is discharged to the outside of the evaporator 300. The refrigerant discharged from the evaporator 300 flows into the second gas-liquid separator 600, and liquid refrigerant stores in the second gas-liquid separator 600 while gas refrigerant in the second gas-liquid separator 600 is sucked into the ejector 400.

Thus, in the fifth embodiment, in the defrosting operation of the evaporator 300, it can prevent liquid refrigerant in the first gas-liquid separator 500 from flowing into the evaporator 300, and the amount of liquid refrigerant in the evaporator 300 is reduced. Accordingly, it can restrict the heat of the hot gas refrigerant from being absorbed by liquid refrigerant in the evaporator 300, and a defrosting time period for which the defrosting operation of the evaporator 300 is performed can be made shorter.

Figure 8:
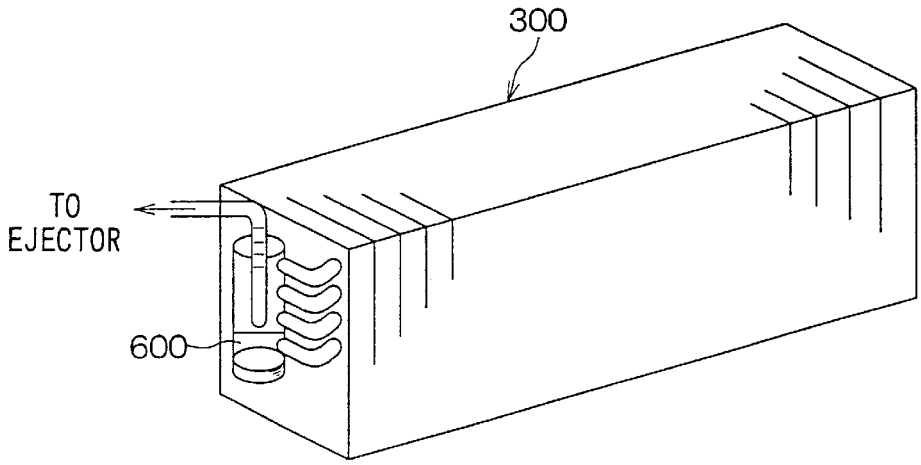
FIG. 8 is a perspective view showing an evaporator used in an ejector cycle system according to a sixth preferred embodiment of the present invention.

A sixth preferred embodiment of the present invention will be described with reference to FIG. 8. In an ejector cycle system of the sixth embodiment, the second gas-liquid separator 600 described in the fifth embodiment and the evaporator 300 are integrated as shown in FIG. 8. In this case, the second gas-liquid separator 600 can be readily mounted on the vehicle, and mounting performance of the ejector cycle system can be improved.

Figure 9:
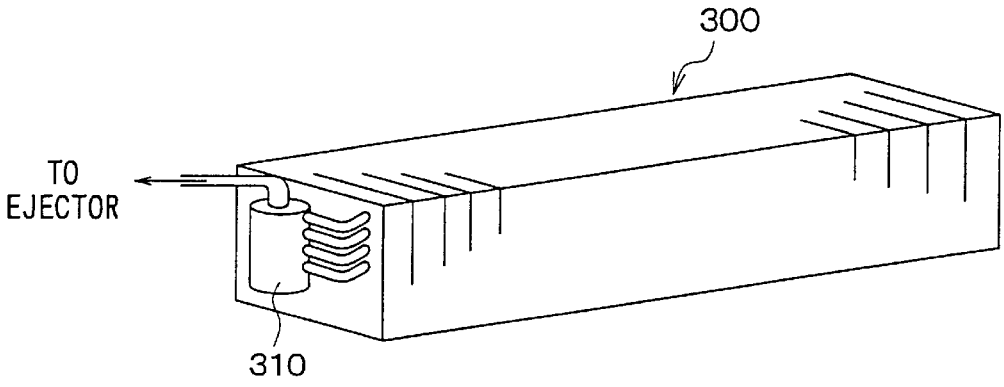
FIG. 9 is a perspective view showing an evaporator used in an ejector cycle system according to a seventh preferred embodiment of the present invention.

A seventh preferred embodiment of the present invention will be now described with reference to FIG. 9. The seventh embodiment is a modification example of the above-described sixth embodiment. In the seventh embodiment, a collection header 310 of the evaporator 300 is constructed to have the function of the above-described second gas-liquid separator 600. In the evaporator 300, the collection header 310 communicates with plural tubes through which refrigerant flows, so that refrigerant from the plural tubes is collected and recovered in the collection header 310. Accordingly, in the seventh embodiment, the advantages described in the fifth and sixth embodiments can be obtained.

Figure 10:
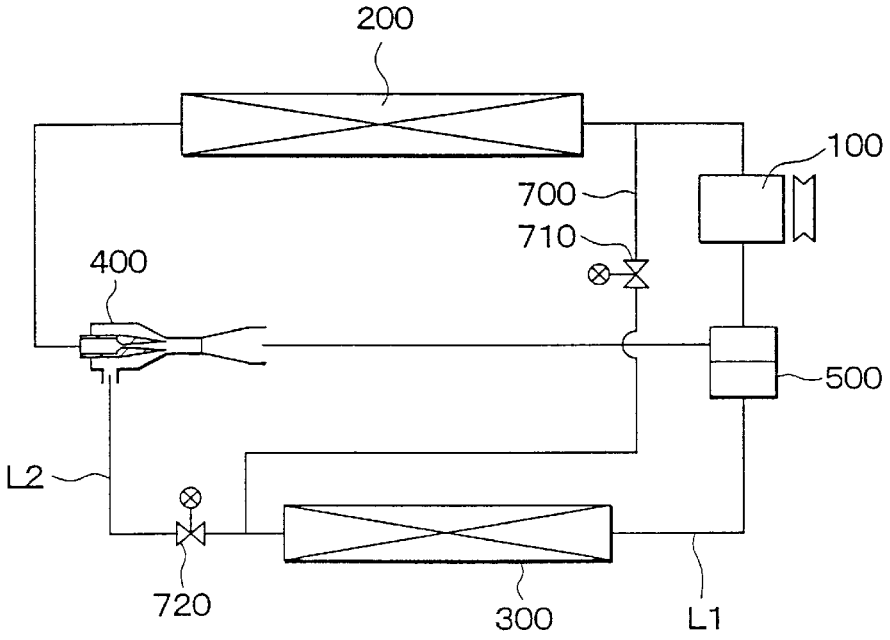
FIG. 10 is a schematic diagram showing an ejector cycle system according to an eighth preferred embodiment of the present invention.

An eighth embodiment of the present invention will be now described with reference to FIG. 10. In the eighth embodiment, the hot gas passage 700 is not connected to the refrigerant passage L1, but is connected to the refrigerant passage L2 connecting the ejector 400 and the evaporator 300. In addition, a valve 720 is disposed in the refrigerant passage L2 to prevent a flow of hot gas refrigerant from the hot gas passage 700 toward the ejector 400 in the defrosting operation.

Accordingly, in the defrosting mode, hot gas refrigerant discharged from the compressor 100 flows into the evaporator 300 through the hot gas passage 700 while bypassing the ejector 400 and the gas-liquid separator 500, and returns to the compressor 100 through the gas-liquid separator 500. Thus, it can prevent liquid refrigerant from flowing into the evaporator 300 in the defrosting operation, and the amount of liquid refrigerant in the evaporator 300 can be reduced. As a result, it can restrict the heat of the hot gas refrigerant from being absorbed by liquid refrigerant in the evaporator 300, and the defrosting time period for which the defrosting operation of the evaporator 300 is performed can be made shorter.

Figure 11:
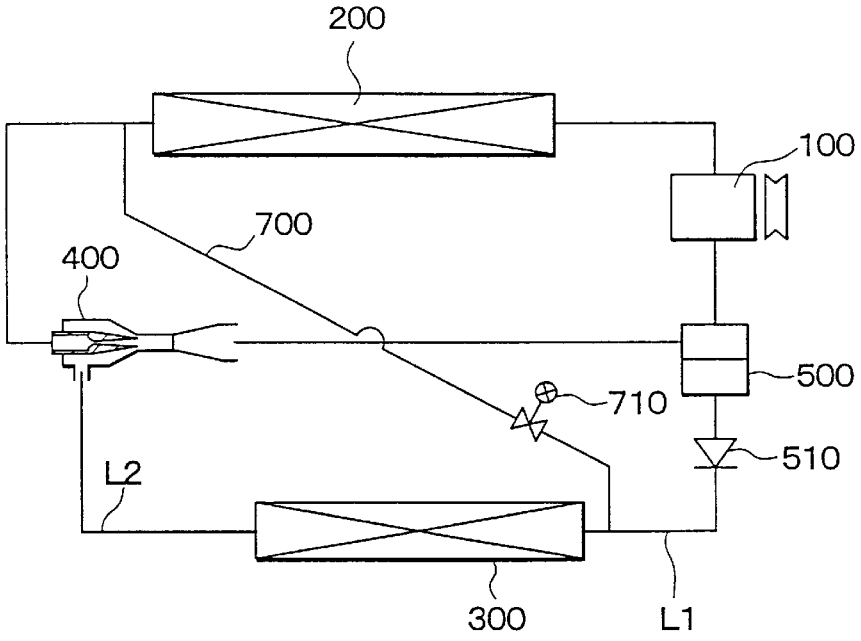
FIG. 11 is a schematic diagrams showing an ejector cycle system according to a ninth preferred embodiment of the present invention.

A ninth preferred embodiment of the present invention will be now described with reference to FIG. 11. In the above-described embodiments, the hot gas passage 700 is connected at a refrigerant inlet side of the radiator 200. However, in the ninth embodiment, as shown in FIG. 11, the hot gas passage 700 is connected to a refrigerant outlet side of the radiator 200. In this case, refrigerant discharged from the radiator 200 can be directly introduced into the evaporator 300 while bypassing the ejector 400 and the gas-liquid separator 500, in the defrosting operation. Similarly, in each of the above-described first and third through seventh embodiments, the hot gas passage 700 can be connected to the refrigerant outlet side of the radiator 200.

Figure 12:
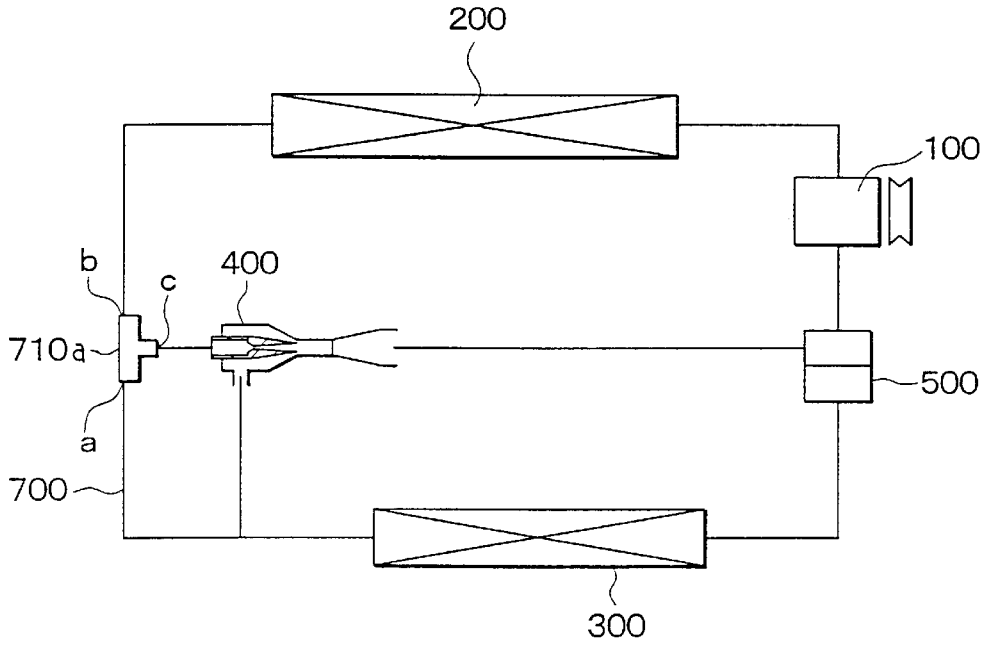
FIG. 12 is a schematic diagram showing an ejector cycle system according to a tenth preferred embodiment of the present invention.

A tenth preferred embodiment of the present invention will be now described with reference to FIG. 12. In the tenth embodiment, a hot gas passage 700 is constructed so that hot gas from the radiator 200 is introduced into the evaporator 300 from a refrigerant inlet side of the nozzle 410 of the ejector 400 in the defrosting operation. In addition, a three-way valve 710*a* is provided in the hot gas passage 700.

When the evaporator 300 is operated to have the heat-absorbing function (cooling function), the "a" side of the valve 710*a* is closed, and refrigerant discharged from the radiator 200 flows from the "b" side to the "a" side in the three-way valve 710*a*. On the other hand, in the defrosting operation, the "c" side of the valve 710*a* is closed, and refrigerant from the radiator 200 flows from the "b" side to the "a" side of the three-way valve 710*a*.

Figure 13:
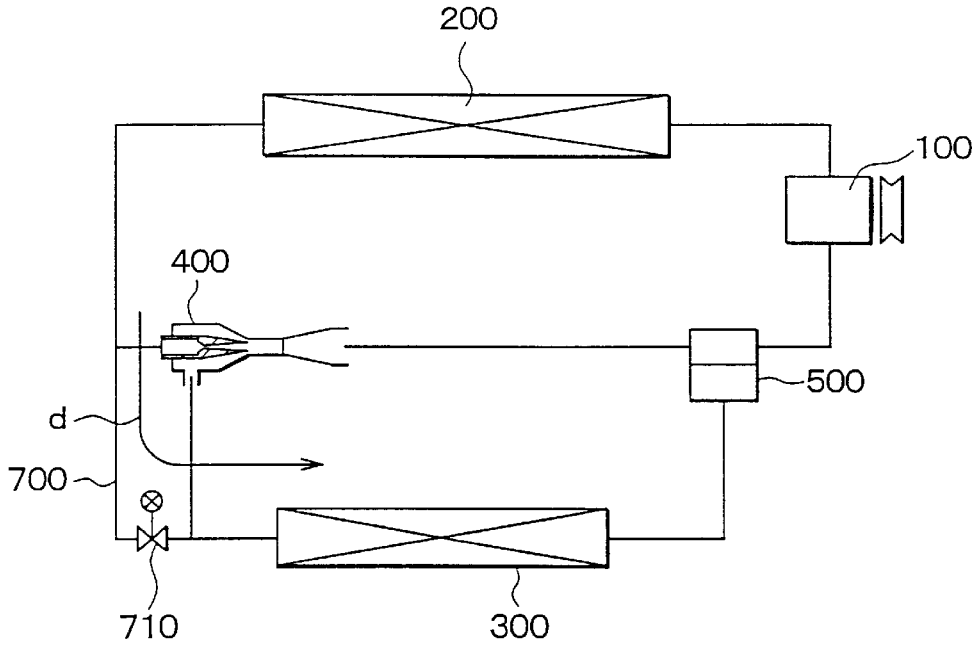
FIG. 13 is a schematic diagrams showing an ejector cycle system according to an eleventh preferred embodiment of the present invention.

An eleventh preferred embodiment of the present invention will be described with reference to FIG. 13. The eleventh embodiment is a modification example of the above-described tenth embodiment. In the eleventh embodiment, as shown in FIG. 13, the hot gas passage 700 is constructed so that refrigerant from the radiator 200 is introduced into the evaporator 300 from the inlet side of the nozzle 410 while bypassing the ejector 400 and the gas-liquid separator 500 in the defrosting operation. In addition, a two-way valve 710 is disposed in the hot gas passage 700.

When the evaporator 300 is operated to have the heat-absorbing function (cooling function), the valve 710 is closed so that high-pressure refrigerant from the radiator 200 flows into the nozzle 410 of the ejector 400. On the other hand, in the defrosting operation, the valve 710 is opened so that the refrigerant from the radiator 200 is introduced into the evaporator 300 through the hot gas passage 700.

Generally, because the pressure loss in the nozzle 410 of the ejector 400 is greatly larger, it can prevent refrigerant flowing from the valve 710 reversely flowing into the nozzle 410. That is, when the valve 710 is opened, it can prevent the refrigerant from being circulated between the nozzle 410 and the valve 710.

Even in the eleventh embodiment, in the defrosting operation, refrigerant discharged from the compressor 100 is introduced into the evaporator 300 through the hot gas passage 700 while bypassing the ejector 400 and the gas-liquid separator 500. Accordingly, it can prevent liquid refrigerant in the gas-liquid separator 500 from flowing into the evaporator 300 in the defrosting operation, and the defrosting time period can be shortened.

Although the present invention has been fully described in connection with the preferred embodiments thereof with reference to the accompanying drawings, it is to be noted that various changes and modifications will become apparent to those skilled in the art.

For example, in the ejector cycle system according to the above-described embodiments, carbon dioxide is used as refrigerant. However, the present invention can be applied to an ejector cycle system where refrigerant such as hydrocarbon and fluorocarbon (flon) is used.

In the above-described embodiments of the present invention, the ejector cycle system is used for a vehicle air conditioner. However, the ejector cycle system can be used for an air conditioner for an any compartment, a cooling unit, or a heating unit using a heat pump.

In the above-described embodiments of the present invention, the valve 710 is provided in the hot gas passage 700. However, the valve 710 can be disposed between the radiator 200 and a branched portion of the hot gas passage 700.

In the above-described embodiments of the present invention, the ejector 400 is a fixed type ejector in which the sectional area of the refrigerant passage of the pressure-increasing portion 420, 430 or the nozzle 410 is fixed. However, in the present invention, a variable-type ejector, in which the sectional area of the refrigerant passage in the nozzle 410 or the pressure-increasing portion 420, 430 is changed in accordance with the heat load or the like, can be also used in the ejector cycle system.

Such changes and modifications are to be understood as being within the scope of the present invention as defined by the appended claims.

What is claimed is:

1. An ejector cycle system comprising:

a compressor for sucking and compressing refrigerant;

a radiator which cools refrigerant discharged from the compressor;

an evaporator for evaporating the refrigerant to obtain cooling capacity;

an ejector including a nozzle for converting a pressure energy of high-pressure refrigerant from the radiator to a speed energy so that the high-pressure refrigerant is decompressed and expanded, and a pressure-increasing portion in which the speed energy is converted to the pressure energy so that the pressure of refrigerant is increased while refrigerant discharged from the nozzle and gas refrigerant from the evaporator are mixed;

a gas-liquid separator for separating refrigerant flowing from the ejector into gas refrigerant and liquid refrigerant, the gas-liquid separator having a gas refrigerant outlet coupled to a refrigerant suction side of the compressor, and a liquid refrigerant outlet coupled to a side of the evaporator; and a bypass passage through which refrigerant discharged from the compressor is introduced into the evaporator while bypassing the ejector and the gas-liquid separator, in a defrosting operation for defrosting the evaporator.

2. The ejector cycle system according to claim 1, wherein:

in the defrosting operation, the refrigerant discharged from the compressor is introduced into the evaporator from a side of the ejector while bypassing the ejector and the gas-liquid separator.

3. The ejector cycle system according to claim 1, further comprising a pressure-loss generating unit, disposed in a refrigerant passage through which the liquid refrigerant outlet of the gas-liquid separator communicates with the evaporator, for generating a predetermined pressure loss in the refrigerant passage.

4. The ejector cycle system according to claim 3, wherein the pressure-loss generating unit is a throttle member.

5. The ejector cycle system according to claim 3, wherein the pressure-loss generating unit is a valve which adjusts an opening degree of the refrigerant passage to generate a predetermined pressure loss in the refrigerant passage.

6. The ejector cycle system according to claim 1, further comprising a check valve, disposed in a refrigerant passage through which the liquid refrigerant outlet of the gas-liquid separator communicates with the evaporator, to prohibit a refrigerant flow from the evaporator to the gas-liquid separator through the refrigerant passage.

7. The ejector cycle system according to claim 1, further comprising an another gas-liquid separator, disposed in a refrigerant passage connecting the evaporator and the ejector, for separating refrigerant from the evaporator into gas refrigerant and liquid refrigerant, wherein the another gas-liquid separator has a refrigerant outlet from which the gas refrigerant separated in the another gas-liquid separator is sucked into the ejector.

8. The ejector cycle system according to claim 7, wherein the another gas-liquid separator is integrated with the evaporator.

9. The ejector cycle system according to claim 1, wherein the bypass passage is connected to a refrigerant inlet side of the radiator such that refrigerant is introduced into the bypass passage from the refrigerant inlet side of the radiator in the defrosting operation.

10. The ejector cycle system according to claim 1, wherein the bypass passage is connected to a refrigerant outlet side of the radiator such that refrigerant is introduced into the bypass passage from the refrigerant outlet side of the radiator in the defrosting operation.

11. The ejector cycle system according to claim 1, further comprising a decompression unit, disposed in the bypass passage, for decompressing refrigerant flowing through the bypass passage in the defrosting operation.

12. The ejector cycle system according to claim 1, further comprising a three-way valve disposed, to allow a refrigerant flow from the bypass passage to the evaporator, and to prohibit a refrigerant flow from one of the ejector and the gas-liquid separator to the evaporator, in the defrosting operation.

13. An ejector cycle system comprising:

a compressor for sucking and compressing refrigerant;

a radiator which cools refrigerant discharged from the compressor;

an evaporator for evaporating the refrigerant to obtain cooling capacity;

an ejector including a nozzle for converting a pressure energy of high-pressure refrigerant from the radiator to a speed energy so that the high-pressure side refrigerant is decompressed and expanded, and a pressure-increasing portion in which the speed energy is converted to the pressure energy so that the pressure of refrigerant is increased while refrigerant discharged from the nozzle and gas refrigerant from the evaporator are mixed;

a first gas-liquid separator for separating refrigerant flowing from the ejector into gas refrigerant and liquid refrigerant, the first gas-liquid separator having a gas refrigerant outlet coupled to a refrigerant suction side of the compressor, and a liquid refrigerant outlet coupled to a side of the evaporator; and bypass means for introducing refrigerant discharged from the compressor into the evaporator while bypassing the ejector and the first gas-liquid separator, in a defrosting operation for defrosting the evaporator.

14. The ejector cycle system according to claim 13, further comprising a second gas-liquid separator, disposed in a refrigerant passage connecting the evaporator and the ejector, for separating refrigerant from the evaporator into gas refrigerant and liquid refrigerant, wherein the second gas-liquid separator has a refrigerant outlet from which the gas refrigerant separated in the second gas-liquid separator is sucked into the ejector.

15. The ejector cycle system according to claim 13, wherein the bypass means includes a pressure-loss generating unit, disposed in a refrigerant passage through which the liquid refrigerant outlet of the first gas-liquid separator communicates with the evaporator, for generating a predetermined pressure loss in the refrigerant passage.

16. The ejector cycle system according to claim 13, wherein the bypass means includes a check valve, disposed in a refrigerant passage through which the liquid refrigerant outlet of the first gas-liquid separator communicates with the evaporator, to prohibit a refrigerant flow from the evaporator to the gas-liquid separator through the refrigerant passage.

17. The ejector cycle system according to claim 13, wherein the bypass means includes a bypass passage through which refrigerant discharged from the compressor is introduced into the evaporator while bypassing the ejector and the first gas-liquid separator in the defrosting operation, and a decompression unit disposed in the bypass passage for decompressing refrigerant flowing through the bypass passage.

* * * * *

UNITED STATES PATENT AND TRADEMARK OFFICE

CERTIFICATE OF CORRECTION

PATENT NO. : 6,584,794 B2 
DATED : July 1, 2003
INVENTOR(S) : Hirotsugu Takeuchi et al.

It is certified that error appears in the above-identified patent and that said Letters Patent is hereby corrected as shown below:

Title page,
Item [30], Foreign Application Priority Data, "(JP) 2000-150786" should be -- (JP) 2002-150786 --

Signed and Sealed this

Twenty-eighth Day of October, 2003

JAMES E. ROGAN
*Director of the United States Patent and Trademark Office*